United States Patent [19]

Muschalik et al.

[11] Patent Number: 4,960,090

[45] Date of Patent: Oct. 2, 1990

[54] LOAD-SHIFTING DEVICE INTENDED FOR AN INTERNAL COMBUSTION ENGINE

[75] Inventors: Gerald Muschalik, Eschborn/TS; Winfried Hahn, Bad Soden/TS, both of Fed. Rep. of Germany

[73] Assignee: VDO Adolf Schindling AG, Frankfurt am Main, Fed. Rep. of Germany

[21] Appl. No.: 334,001

[22] Filed: Apr. 4, 1989

[30] Foreign Application Priority Data

Jul. 6, 1988 [DE] Fed. Rep. of Germany ..... 3822843

[51] Int. Cl.[5] ..... F02D 11/10

[52] U.S. Cl. ..... 123/399; 123/361

[58] Field of Search ..... 123/361, 399

[56] References Cited

U.S. PATENT DOCUMENTS 4,586,471 5/1986 Horada et al. ..... 123/361 X 4,655,180 4/1987 Bauer et al. ..... 123/361

FOREIGN PATENT DOCUMENTS 122742 7/1984 Japan ..... 123/399

*Primary Examiner*—Tony M. Argenbright

*Attorney, Agent, or Firm*—Martin A. Farber

[57] ABSTRACT

In a load-shifting device, a switch arm (7) is mounted on a driven shaft (3) and is turnable relative to the driven shaft (3) and urged in the direction of a switch contact (9) by a spring (8) which is wound around the driven shaft (3). The spring (8) is developed as an electric conductor. On one leg (13) it has a connecting piece (20) while its other leg (11) directly contacts the switch contact (9).

10 Claims, 2 Drawing Sheets

LOAD-SHIFTING DEVICE INTENDED FOR AN INTERNAL COMBUSTION ENGINE

FIELD AND BACKGROUND OF THE INVENTION

The present invention refers to a load-shifting device intended for an internal combustion engine and having a drive shaft provided for the displacement of a throttle valve as well as a controlling-element switch which has a swingably mounted switch arm which is urged by a spring against a switch contact connected to an electrical pole, the switch arm resting against a switch contact in the idling position but being moved away from the switch contact somewhat above the idling position by the drive shaft against the force of the spring.

Load-shifting devices of this kind are used in electric gas-pedal systems and are generally known. In the load-shifting devices known up to the present time the switch arm is swung by an eccentric which is seated on the drive shaft. In this way, rubbing necessarily takes place between the switch arm and the eccentric, resulting in wear. A further disadvantage of the actuation of the switch arm by an eccentric is that the accuracy of switching is frequently not sufficiently great since manufacturing tolerances substantially shift the switch point to an undesiredly great extent.

SUMMARY OF THE INVENTION

It is an object of the invention so to develop a load-shifting device of the aforementioned type that it operates, as far as possible, without friction and thus is low in wear and does not require narrow manufacturing tolerances in order to obtain an exact switch point.

According to the invention, a spring (8) is a torsion spring which surrounds the drive shaft (3) and is held fast to a housing by one free leg (13) while its other free leg (11) rests, on the switch-contact side, against a switch arm (7), the free leg (11) which rests against the switch arm (7) being developed for contacting a switch contact (9) which is connected to one pole and the other leg (13) of the spring (8) being developed for connection to the other pole. A driver connection (driver (10), stop (19)) is provided between the drive shaft (3) and the switch arm (7) for the swinging of the switch arm (7).

By this construction, in accordance with the invention, switch actuation without wiping friction is possible. The spring which wraps around the driven shaft has a multiple function. It exerts a restoring moment on the switch arm and produces the necessary force of application against the switch contact. Furthermore, it serves to conduct the current and forms a connection for an electric pole.

One particularly simple driver connection is characterized by the fact that the driver (10) which is moveable by rotation of the drive shaft (3) from the side of the switch contact (9) against a stop (19) of the switch arm (7) is provided on the drive shaft (3).

The urging of the shift arm toward the switch contact can be produced in very simple fashion in the manner that the free leg (11) of the spring (8) is conducted close to the drive shaft (3) on the side of the switch arm (7) facing away from the switch contact (9) and close to the free end of the switch arm (7) through an opening (12) back to the side of the switch arm (7) facing the switch contact (9).

Even after contacting the switch contact, the switch arm can move slightly further up against a stop which is fixed on the housing if, in accordance with one advantageous feature of the invention, the switch contact (9) is located near the free end of a spring tongue (14).

A particularly high reliability of contact is obtained if the switch contact (9) has contact pieces (15,16) lying alongside of each other in the longitudinal direction of the free leg of the spring (8).

The switch point of the controlling-element switch can be adjusted in a very simple manner if the stop (19) is developed displaceably on the switch arm (7).

The position of rest of the controlling-element switch is established unequivocally and at little expense if the switch arm (7) has a projection (17) which is moveable against a stop (18) fastened to the housing after the contacting of the switch contact (9).

The connecting of an electric wire to one end of the spring is simple to effect if the end (leg 13) of the spring (8) leading to the switch arm extends initially radially outward and then, in the radial plane to the drive shaft (3), in U-shape back in the direction of the drive shaft and then extends by means of a connecting piece (20) approximately parallel to the drive shaft (3).

The solder connection between an electric wire and the connecting piece of the spring can be produced particularly rapidly and reliably if a connecting piece (20) is developed wound in cork-screw manner at its free end.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENT

Figure 1:
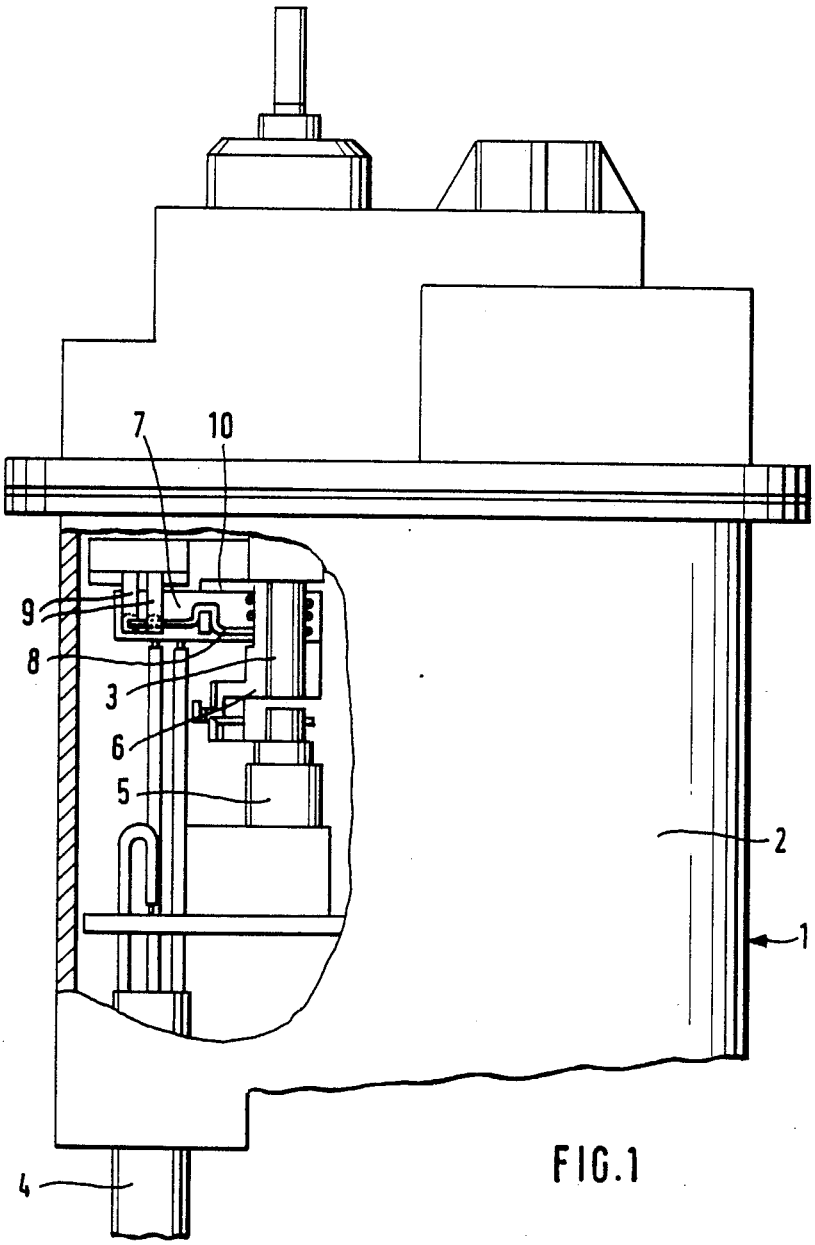
FIG. 1 is a partially cut-away side view of a load-shifting device in accordance with the invention.
Figure 2:
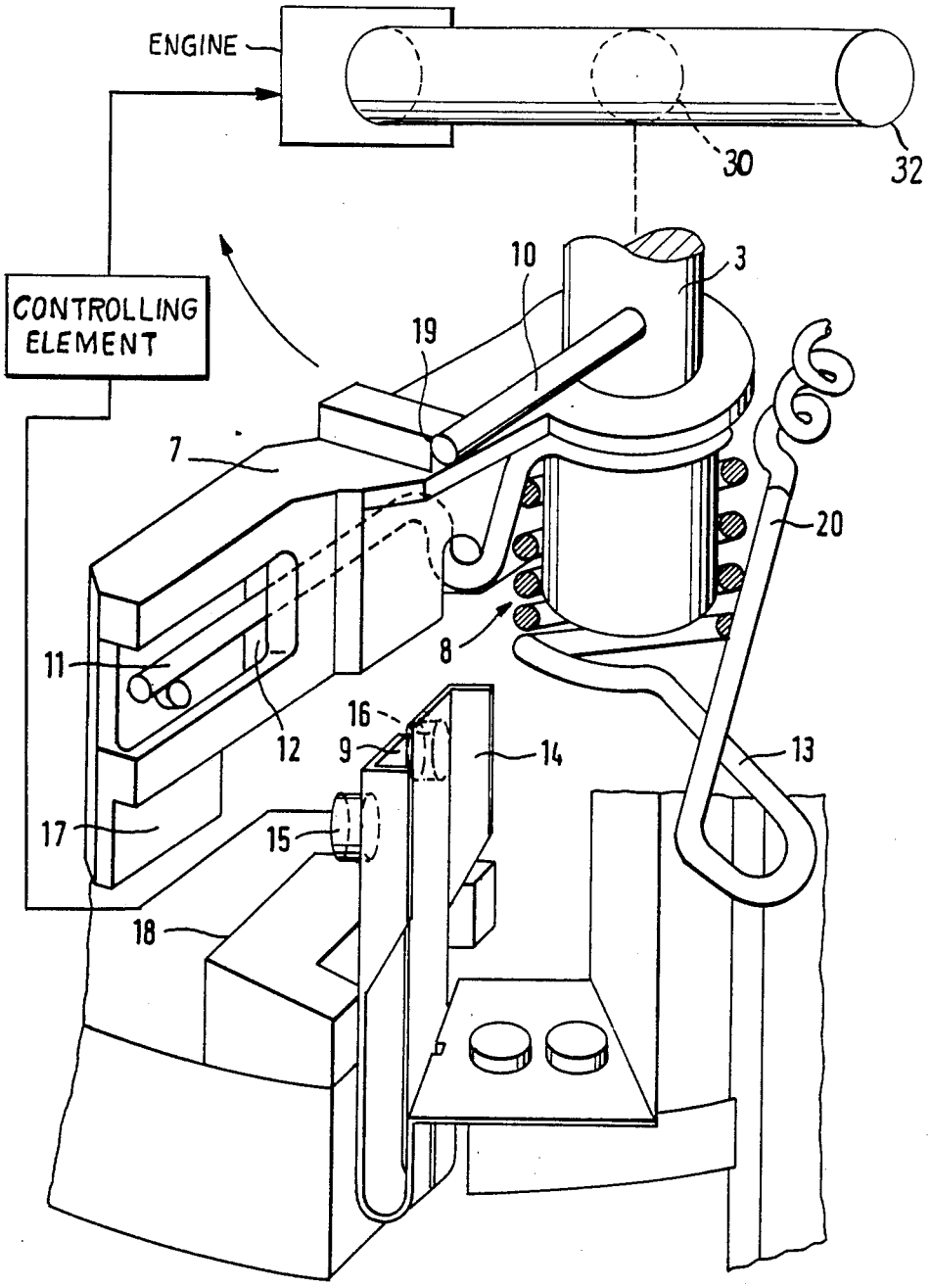
FIG. 2 is a perspective view of a region, essential for the invention, within the load-shifting device of FIG. 1.

The load-shifting device, shown as a whole in FIG. 1, and in amplified view in FIG. 2, has a housing 1 which contains a servomotor 2 for displacing a drive shaft 3 which extends upward out of the housing 1 and serves for displacing a throttle valve 30 indicated diagrammatically in an air-fuel intake pipe 32 of the internal combustion engine of a motor vehicle. The servomotor 2 is supplied with current via a cable 4 which, as seen in FIG. 1, extends from below into the housing 1.

Aligned with the drive shaft 3 is a rotary resistor 5 which is actuated by a driver 6 which is seated on the drive shaft 3 and reports the instantaneous position of the drive shaft 3 to an electronic controller (not shown).

There is, important for the invention, a switch arm 7 which is disposed on the drive shaft 3 and held, rotatable on it relative to the drive shaft 3, and is urged by a spring 8 against a switch contact 9. In the idling position, the switch arm 7 lies against the switch contact 9. If the throttle valve 30 opens, then a rod-shaped driver 10, which is secured fixedly to and extends outwardly from the drive shaft 3, carries the switch arm 7 so that the latter moves away from the switch contact 9 and thereby interrupts an electric connection extending via the spring 8 to the switch contact 9.

FIG. 2 shows the development of the switch arm 7 seated on the drive shaft 3. It is noted that a free leg 11 of the spring 8, after being wrapped several times around the drive shaft 3, first of all engages behind the switch arm 7 but then, close to the free end of the switch arm 7, is conducted through an opening 12 back to the side of the switch contact 9. The other free leg 13 extends initially from the drive shaft 3 radially outward, where it is clamped firm to the housing in a manner not shown in the drawing, and then conducted by means of a connecting piece 20 obliquely upward. There it is wound in the form of a cork screw so that an electric connection can easily be soldered on at this end.

The switch contact 9 is provided close to the end of a spring tongue 14 and has two contact pole pieces 15,16 alongside of each other which are simultaneously contacted by the leg 11 of the spring 8. After this contacting, the switch arm 7 can move slightly further until, by a projection 17, it comes against a stop 18 which is fixed to the housing.

From FIG. 2 it can furthermore be noted that the driver 10 of the drive shaft 3 rests against a stop 19 of the switch arm 7 and is capable of carrying the latter with it against the force of the spring 8 when the drive shaft 3 turns in clockwise direction.

We claim:

1. A load-shifting device for an internal combustion engine, the engine receiving a mixture of fuel and air by means of a throttle valve, the device comprising a drive shaft for operating throttle valve;

a controlling-element switch which has a pivotally mounted switch arm and a switch contact;

a spring which urges the switch arm against the switch contact, the switch arm resting against the switch contact in an idling position for idling of the engine, the switch arm being moved from the switch contact above the idling position by the drive shaft against a force of the spring;

a housing; and drive means operatively connected between the drive shaft and the switch arm, the drive means including a drive element connecting with the drive shaft and a stop positioned on the switch arm for engagement with the drive element, and wherein the spring is a torsion spring which surrounds the drive shaft and has a first free leg and a second free leg, the spring being held fast to the housing by the first free leg, the second free leg resting, on the switch-contact side, against the switch arm;

the switch contact comprises a first pole, the switch including a second pole, the second free leg being oriented for contacting the first pole and the first free leg being positioned for connection to the second pole; and the drive means includes a swinging of the switch arm.

2. A load shifting device according to claim 1, wherein the drive element, is moveable by rotation of the drive shaft from a side of the switch contact against the stop on the switch arm, the drive element being located on the drive shaft.

3. A load shifting device according to claim 2, wherein the second free leg of the spring is conducted close to the drive shaft on the side of the switch arm facing away from the switch contact and close to a free end of the switch arm through an opening therein back to the side of the switch arm facing the switch contact.

4. A load shifting device according to claim 1, wherein the second free leg of the spring is conducted close to the drive shaft on the side of the switch arm facing away from the switch contact and close to a free end of the switch arm through an opening therein back to the side of the switch arm facing the switch contact.

5. A load shifting device according to claim 1, wherein the switch includes a spring tongue, and the switch contact is located near a free end of the spring tongue.

6. A load shifting device according to claim 1, wherein the switch contact has contact pieces lying alongside of each other in the longitudinal direction of the second free leg of the spring.

7. A load shifting device according to claim 1, wherein the stop is developed displaceably on the switch arm.

8. A load shifting device according to claim 1, wherein the switch arm has a projection which is moveable against a further stop fastened to the housing upon a contacting of the switch contact.

9. A load shifting device according to claim 1, wherein the second end of the spring leads to the switch arm and extends initially radially outward from the drive shaft and then, in the radial plane to the drive shaft, in U-shape back in the direction of the drive shaft and then extends by means of a connecting piece approximately parallel to the drive shaft.

10. A load shifting device according to claim 1, wherein the connecting piece is developed wound in cork-screw manner at a free end thereof.

* * * * *